US005499738A

United States Patent [19]

Burleigh

[11] Patent Number: 5,499,738

[45] Date of Patent: Mar. 19, 1996

[54] CONTAINER FOR HOLDING PRESSURIZED LIQUIDS

[76] Inventor: Howard I. Burleigh, 2 Heron Grove, Leeds, LS17 8XF, United Kingdom

[21] Appl. No.: 208,077

[22] Filed: Mar. 9, 1994

Related U.S. Application Data

[63] Continuation of Ser. No. 26,984, Mar. 5, 1993, abandoned.

[30] Foreign Application Priority Data

Mar. 11, 1992 [GB] United Kingdom ..... 9205277

[51] Int. Cl.[6] ..... B65D 1/24

[52] U.S. Cl. ..... 220/504; 220/524; 220/602; 215/6; 215/395

[58] Field of Search ..... 215/6, 100 R, 215/2, DIG. 7, 1 C, 6, 395; 220/523, 524, 503, 504, 400, 408, 410, 903, 737, 739, 212, 602, 662, 630, 636, 625; D6/310

[56] References Cited

U.S. PATENT DOCUMENTS

| | | | |
|---|---|---|---|
| 2,125,113 | 7/1938 | Kling | 220/662 |
| 2,833,436 | 5/1958 | Ruderian | 215/6 |
| 3,326,358 | 6/1967 | Singleton | 215/6 |
| 3,465,905 | 9/1969 | Schottanes | 215/6 |
| 4,113,097 | 9/1978 | Finn | 215/6 |
| 4,150,761 | 4/1979 | Collins | 215/DIG. 7 |
| 4,552,275 | 11/1985 | Chang et al. | 215/100 R |
| 4,603,784 | 8/1986 | Chang | 215/6 |
| 4,955,493 | 9/1990 | Touzani | 215/100 R |
| 5,160,049 | 11/1992 | McMillan, Jr. | D6/310 |

*Primary Examiner*—Stephen J. Castellano

*Attorney, Agent, or Firm*—D. Peter Hochberg; Mark Kusner; Michael Jaffe

[57] ABSTRACT

A container, for holding consumable substances, having a plurality of closures adapted to restrain the contained substances and dividing walls to divide the container into a plurality of substance-holding compartments, each compartment being associated with one closure respectively.

4 Claims, 3 Drawing Sheets

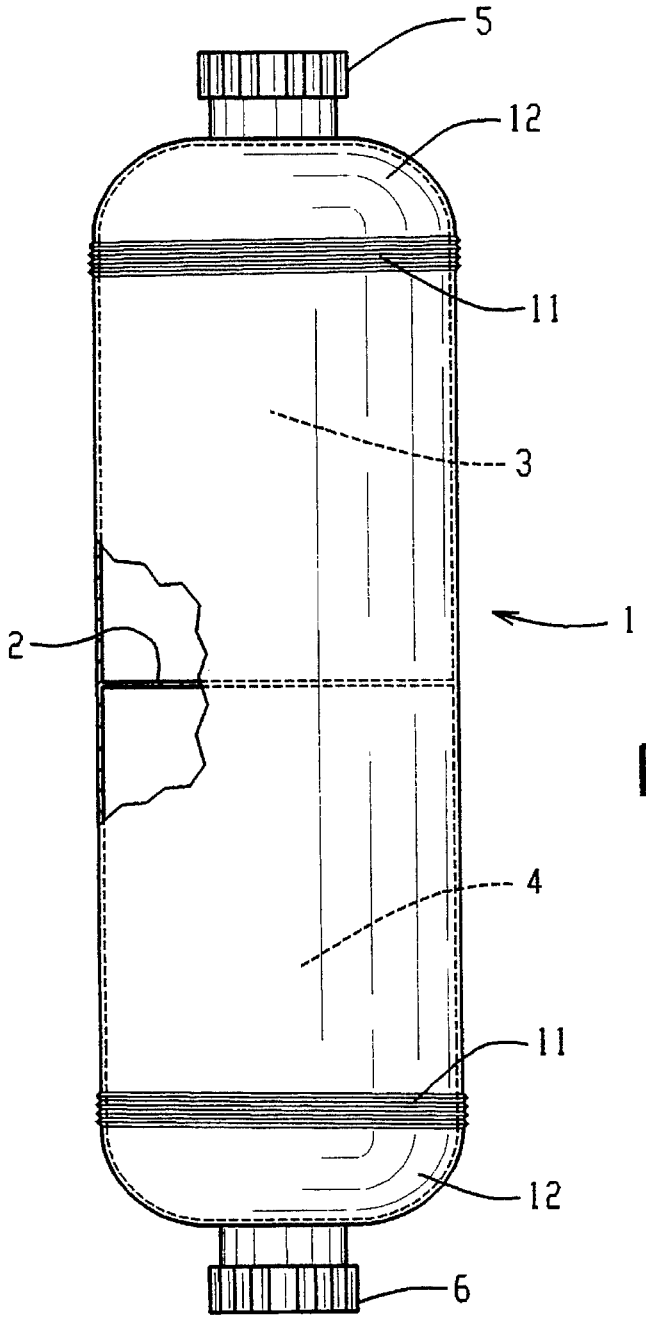
FIG. 1
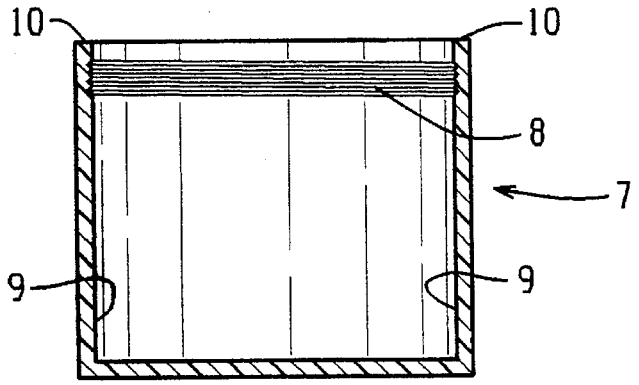

CONTAINER FOR HOLDING PRESSURIZED LIQUIDS

This is a continuation of application Ser. No. 08/026,984 filed on Mar. 5, 1993, now abandoned.

BACKGROUND OF THE INVENTION

This invention relates to containers for holding consumable substances and more particularly, but not exclusively, to containers for holding carbonated liquids.

Carbonated drinks have been available for over a century, and it is a well recognised problem with them that when exposed to air for a significant amount of time or repeatedly, they tend to lose their fizz, i.e. go flat. As a result, such drinks have tended to be sold in small containers in quantities that can be drunk all at once. More recently however, larger containers, such as the one, two or even three liter bottle, have been used. Consequently the problem of the drink going flat has been brought to prominence, because the container is repeatedly opened and then reclosed in order to serve relatively small drink portions and then leave the remainder stored in the container. This repeated exposure to air of the stored drink tends to make the last servings of the drink go flat. Nevertheless, large containers are more economical to produce and easier to handle than the equivalent number of smaller containers. However, there is associated with them pressure on the consumer to empty the entire container all at once, because of the tendency of the last servings of the drink to go flat if the container is repeatedly opened and closed, as described hereinbefore.

SUMMARY OF THE INVENTION

It is therefore an object of the invention to combine the economy and ease of handling of a larger container, with the avoidance or reduction of the problem of exposure to air which is solved by a smaller container.

According to the invention there is provided a container for holding one or more consumable substances, having a plurality of closures adapted to restrain the said substances, and dividing means to divide the container into a plurality of substance-holding compartments, each compartment being associated with one closure respectively.

Preferably the closures are adapted to restrain liquid and, in a preferred embodiment they are airtight.

The invention provides a container divided into a plurality of separately-accessible substance-holding compartments. Substance stored in one compartment may be kept fresh or fizzy while more substance is taken from another compartment. In this way later servings of the substance as a whole can be kept fresh or fizzy.

According to a particularly favoured embodiment of the invention two closures are provided, each associated with a respective one of two compartments. The two closures may be sited at opposite regions of the container.

Attachment means may be provided at each opposite portion of the container for a detachable stand, and such a stand may be transparent.

The container may comprise bottles, cans, jars, flasks, or a combination thereof.

BRIEF DESCRIPTION OF THE DRAWINGS

For a better understanding of the invention and to show how the same may be carried into effect, reference will now be made, purely by way of example to the attached drawings in which:

FIG. 1 shows a side view of a first container according to the invention;

DESCRIPTION OF THE PREFERRED EMBODIMENTS

Figure 4:
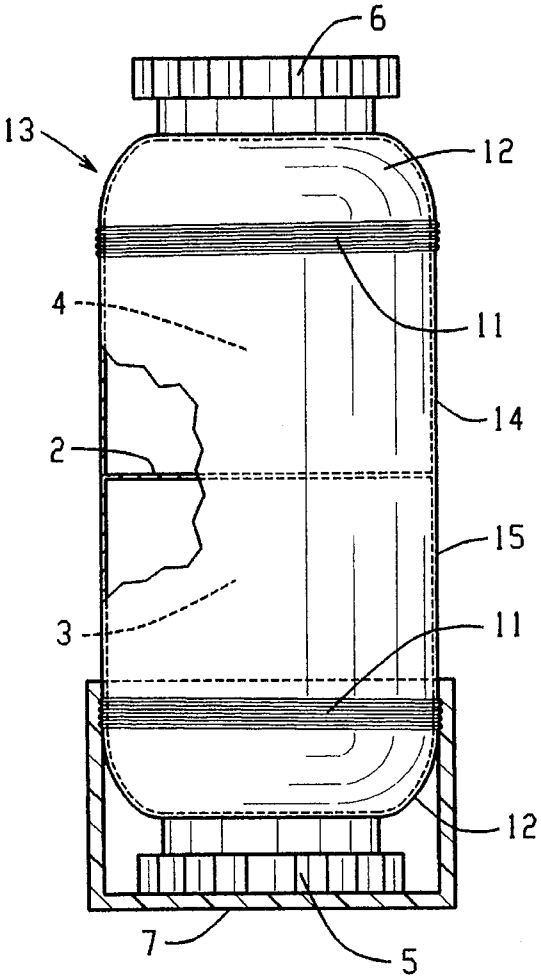
FIGS. 2–4 show side views of a second container according to the invention in successive stages of use.

FIG. 1 shows a side view of a container according to the invention. A circularly cylindrical plastics container 1, based on a double-ended bottle shape, comprises a central divider 2 which divides the interior of the container 1 into two separate compartments 3 and 4. Each compartment 3,4 is completely isolated from the other so that when one compartment is full of carbonated liquid (e.g. beer or lemonade) and the other is empty or partially empty after repeated servings therefrom, the liquid in the full compartment will retain its fizz completely.

Each compartment 3,4 has associated with it its own closure 5,6, being a screw-on stopper which is able to retain liquid within its respective compartment in conventional manner. The stoppers 5,6 are located at the two respective opposite ends of the container 1. There is provided a detachable plastics stand 7 which is circularly cylindrical and is cup-shaped, and comprises screw threads 8 around the inner circumference of its interior surface 9 just below its funnelled rim 10. Cooperable screw threads 11 are provided around the outer circumference of each end of the container 1, before a tapered portion 12 which leads into a neck for the associated stopper 5,6. The stand 7 may be securely screwed onto whichever of the two ends of the container 1 is not in use at the time, so that the container 1 can stand upright on the stand 7 with one end of the container being uppermost and the other end held in the stand 7.

The stand 7 is made of a transparent material, so that shoppers will appreciate that they are buying double-ended containers having the attendant advantages regarding keeping the contents fresh and fizzy, when they see them on supermarket shelves.

Figure 3:
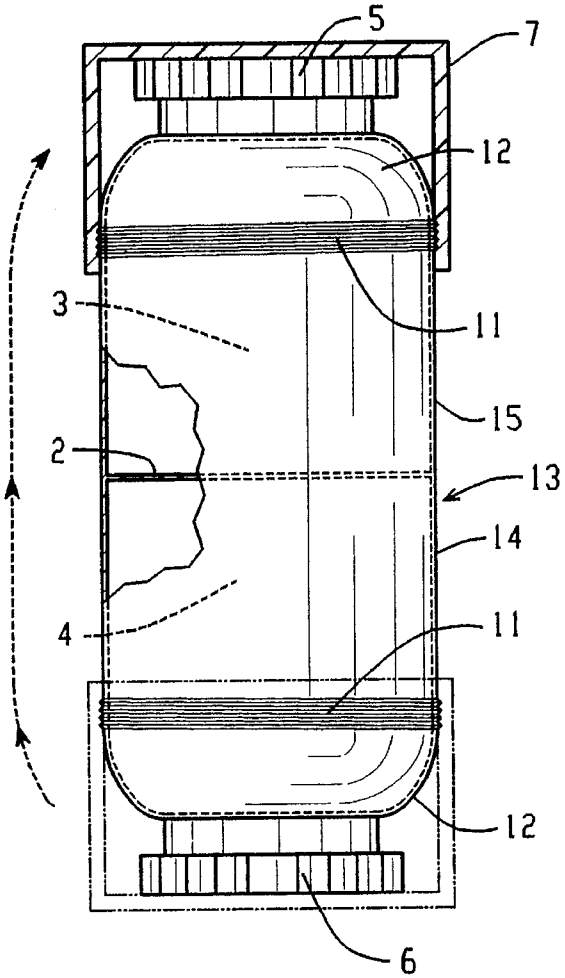
Figure 2:
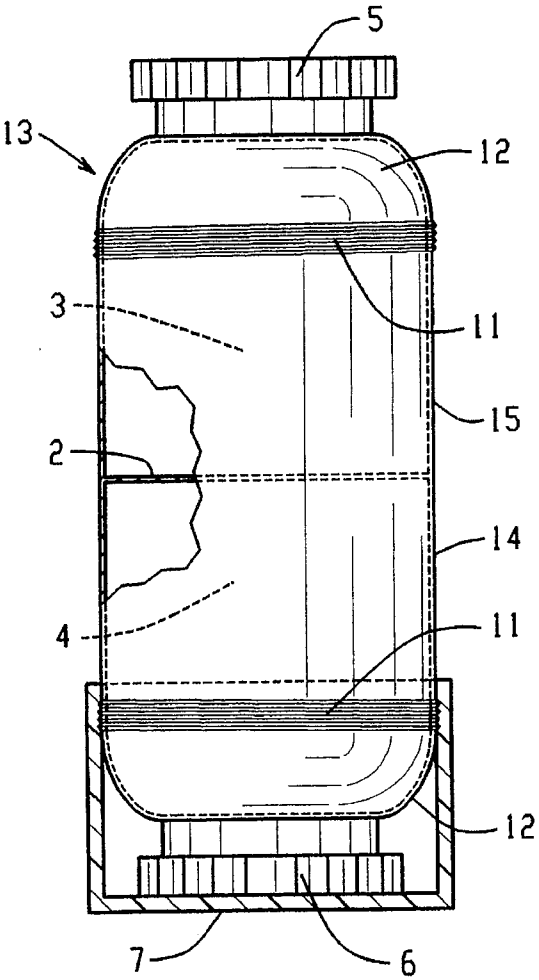

FIGS. 2–4 show a container 13, based on a jar shape, in successive stages of use. Apart from being jar-shaped, the container 13 and its stand 7 can be identical to the bottle-shaped container 1 and stand 7 of FIG. 1.

In FIG. 2 the detachable stand 7 is fixed by screwing to a lower end 14 of the container 13, whilst the contents of the chamber 3 at an upper end 15 of the container 13 are consumed either all at once, or in stages with repeated openings and closings of the screw-on closure 5.

In FIG. 3, once the compartment 3 towards the upper end 15 is empty, or if a serving of a different drink is required, the detachable stand 7 is removed by unscrewing from the lower end 14 and is then attached by screwing onto the upper end 15. Then, as shown in FIG. 4, the container 13 is inverted so that the initially lower end 14 becomes the upper end and can be used for drinking immediately, or may alternatively be left for another time without any danger of the drink going flat.

Figure 5:
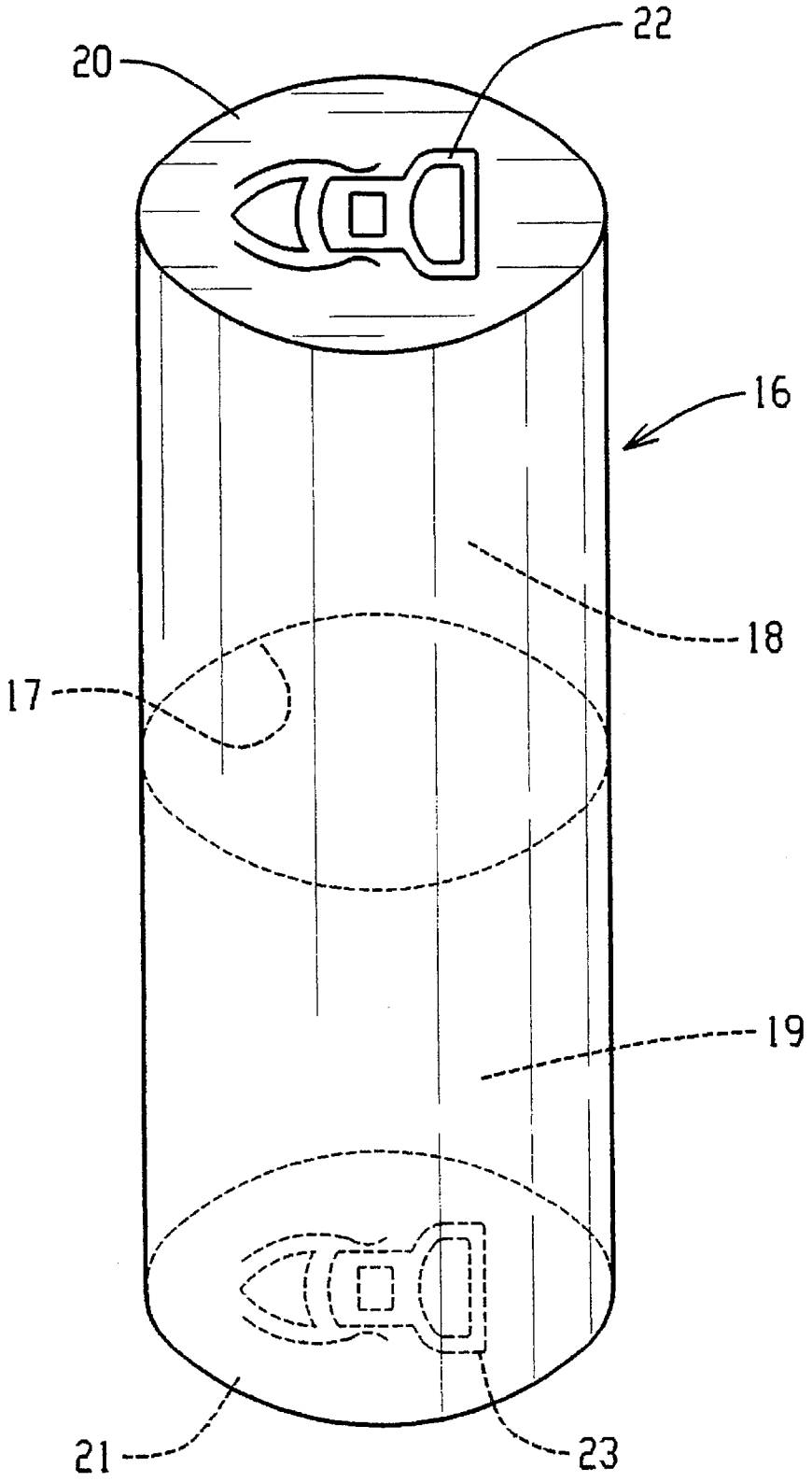
FIG. 5 shows a perspective diagrammatic view of a third container according to the invention.

FIG. 5 shows an alternative embodiment of the invention. A metal container 16 is based on a can shape. A central divider 17 divides the interior of the container into two separate compartments 18 and 19. As in the two previous embodiments the two compartments 18,19 are isolated from each other. Each compartment 18,19 has associated with it its own closure 20,21 being a metal end seal with a ring pull 22,23. In this embodiment, both ends of the container have conventional upstanding rims and are therefore stable and thus no separate stand is necessary, although one could be provided if desired. As will be readily appreciated, the contents of a first compartment 18 or 19 must be finished once opened before the container is inverted to use the second compartment.

There is thus provided by each embodiment a container able to hold fizzy drinks in relatively large quantities and yet maintain the fizziness of the drink as if it were a smaller container. As an alternative to putting the same drink in both compartments, different drinks may be provided in the separate compartments of the same container.

A container according to the invention may be made of any suitable material, although plastics is preferred for the embodiments of FIGS. 1 to 4, and metal for FIG. 5. However, glass could be used if desired, particularly for the embodiments of FIGS. 1 to 4.

In FIGS. 1 to 4 each container is circularly cylindrical and the detachable stand 7 is secured thereto by a screw thread. In alternative embodiments however, the container and the stand may be for example square in cross-section. In such a case the stand 7 could for example be secured to the container by releasably interlocking ribs replacing the illustrated screw threads.

A container according to the invention may be manufactured as a single cylindrical article, with the central divider 2 or 17 provided across the centre of the article to separate it into two mutually-sealed cavities to provide the compartments 3 and 4 or 18 and 19.

Alternatively, a container according to the invention may be provided by two separate and smaller containers joined together. Thus, in FIGS. 1 to 5 each container shown may comprise two smaller and identical containers joined together end-to-end.

For example, plastics bottles are often moulded with a rounded bottom. A container according to the invention could comprise two such bottles joined together end-to-end by a sleeve which receives the bottoms of the two bottles. In such an embodiment the dividing means of the invention would be constituted by the adjacent ends of the two bottles.

INDUSTRIAL APPLICABILITY

It will be appreciated that a container according to the invention may be filled with any type of consumable substance which is best served fresh. The specific examples of carbonated drinks such as beer and lemonade have been given, and it will be understood that the embodiments of FIGS. 1 and 5 are particularly well adapted for receiving liquids to be drunk. However, a container according to the invention is not restricted to such use, and a more jar-shaped embodiment such as shown in FIGS. 2 to 4 could alternatively be used for containing other types of consumable substances also which are best kept fresh before serving, such as jams or bottled fruits. The invention may also have medical applications, the consumable substances being medicines for example.

I claim:

1. A container and attachment containing at least one pressurized liquid comprised of:

a single piece, molded body having a generally cylindrical central portion and funnel shaped end portions, said body defining an interior cavity having an opening through each of said end portions;

a wall portion integrally formed within said body dividing the interior cavity into two liquid holding compartments;

a liquid under pressure within one of said liquid holding compartments;

a pair of one piece closure members attachable to said end portions, each closure member be attachable to one of said end portions to form a pressure-tight seal therewith for closing said liquid holding compartment;

external threaded attachment means integrally formed on said cylindrical portion of said single piece, molded body adjacent said end portions; and a single, detachable transparent cup-shaped attachment having a generally cylindrical body and a planar end portion, said cup shaped attachment receiving one funnel-shaped end portion and having internal threads formed along the inner surface of said cylindrical body, said internal threads matingly receiving the external threaded attachment means on said cylindrical portion of said single piece molded body to secure said attachment to said body.

2. A container and attachment containing at least one pressurized liquid comprised of:

a single piece, molded body having a generally cylindrical central portion and funnel shaped end portions, said body defining an interior cavity having an opening through each of said end portions;

a wall portion integrally formed within said body dividing the interior cavity into two liquid holding compartments;

a liquid under pressure within one of said liquid holding compartments;

a pair of one piece closure members attachable to said end portions, each closure member be attachable to one of said end portions to form a pressure-tight seal therewith for closing said liquid holding compartment;

external threaded attachment means integrally formed on said cylindrical portion of said single piece, molded body adjacent said end portions; and a single, detachable cup-shaped attachment having a generally cylindrical body and a planar end portion, said cup shaped attachment receiving one funnel-shaped end portion and having internal threads formed along the inner surface of said cylindrical body, said internal threads matingly receiving the external threaded attachment means on said cylindrical portion of said single piece molded body to secure said attachment to said body, wherein said funnel-shaped end portions are symmetrical about the axis of said cylindrical body and said closure members include planar portions which are perpendicular to said axis when said closure members are attached to said end portions, and said cup-shaped attachment is dimensioned such that said planar portion of said closure member engages said inner planar end portion of said cup-shaped attachment when said attachment is secured to said body.

3. A container as defined in claim 2 wherein said container is a bottle.

4. A container as defined in claim 2 being made of at least one of the group of materials consisting of plastic, glass and metal.

* * * * *